United States Patent [19]

Wamser

[11] Patent Number: 4,634,104

[45] Date of Patent: Jan. 6, 1987

[54] HOODED METALLURGICAL VESSEL

[75] Inventor: Karl Wamser, Moers, Fed. Rep. of Germany

[73] Assignee: Mannesmann Aktiengesellschaft, Dusseldorf, Fed. Rep. of Germany

[21] Appl. No.: 756,601

[22] Filed: Jul. 19, 1985

[30] Foreign Application Priority Data

Jul. 19, 1984 [DE] Fed. Rep. of Germany ..... 3427087

[51] Int. Cl.[4] ..... C21C 5/38

[52] U.S. Cl. ..... 266/158; 373/9

[58] Field of Search ..... 266/158; 373/8, 9

[56] References Cited

U.S. PATENT DOCUMENTS 3,721,743 3/1973 Shiina et al. ..... 373/9

4,405,363 9/1983 Tivelius ..... 266/158

FOREIGN PATENT DOCUMENTS 2848948 12/1982 Fed. Rep. of Germany .

*Primary Examiner*—L. Dewayne Rutledge

*Assistant Examiner*—Robert L. McDowell

*Attorney, Agent, or Firm*—Oblon, Fisher, Spivak, McClelland, & Maier

[57] ABSTRACT

An upwardly open vessel which, in use, contains a metallurgical melt, the upwardly open vessel having an upper rim. A suction hood having a lower rim sized and shaped so that, in use, the lower rim of the suction hood opposes the upper rim of the upwardly open vessel but is spaced therefrom to permit ambient air to enter through an annular gap therebetween. A covering bell having a lower rim is mounted on the underside of the suction hood in position so that, in use, the lower rim of the covering bell isolates a portion of a slag cover on a metallurgical melt in the upwardly open vessel. Corresponding openings are provided in the suction hood and the covering bell to permit access to the isolated portion of the slag cover by an externally operated probe or the like.

9 Claims, 1 Drawing Figure

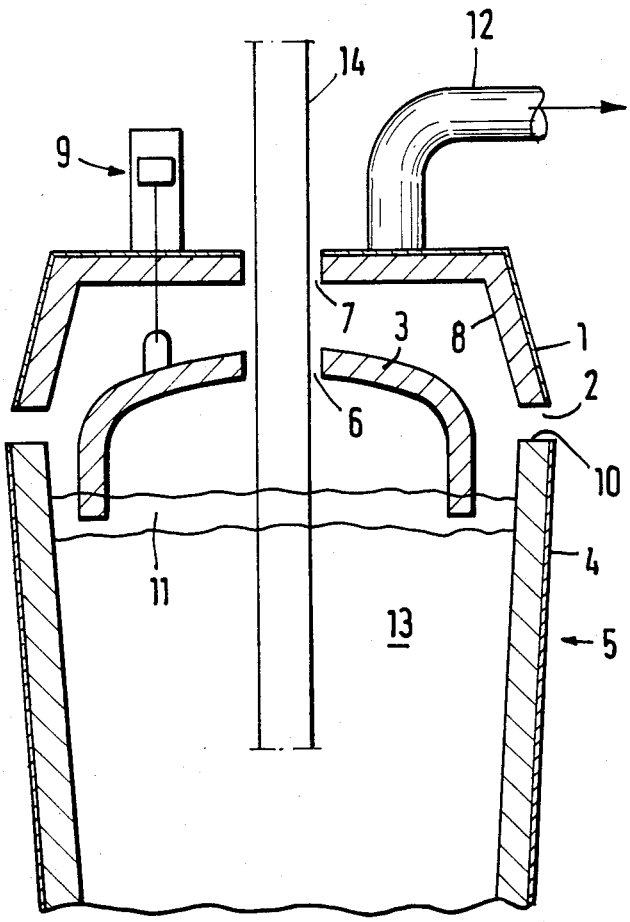
12
14
9
7
3
8
1
2
6
10
11
4
13
5

HOODED METALLURGICAL VESSEL

BACKGROUND OF THE INVENTION

1. Field of the Invention

The invention relates to a metallurgical vessel for production and/or treatment of molten metals, especially of steel melts.

2. Discussion of Background

For years it has been common practice to cover metallurgical vessels such as pot furnaces and arc furnaces towards the top for reasons of industrial safety and environmental protection. Additionally, it has been common practice to connect such vessels to a device for suctioning off the gases and dusts developed in them during processing. Such a device is known, for example, from Techn. Mitt. Krupp, Vol. 18 (1960), No. 3 at page 111 and also from West German Published Patent Document DE-PS No. 28 48 948.

On the other hand, molten metals with especially high degrees of purity are increasingly in demand. This means, e.g., for steel metals adhering to extremely small contents of oxygen and/or nitrogen. Such contents can be achieved only if the steel melt during the pot treatment is shielded from the ambient air as completely as possible (e.g., by use of protective gas or by processing in vacuum). For the production of steels with extremely low oxygen contents, a device has been proposed in U.S. Pat. No. 4,405,363 which essentially consists of a pot and a suction hood provided with a heat shield. The sheet shield covers the pot virtually completely. However, a continuous air gap is left between the rim of the pot and the heat shield. The suction hood extends downwardly beyond the air gap. The outer wall of the suction hood forms a continuous opening with the wall of the vessel through which ambient air can be drawn by means of a connected suction device. The suction hood and/or the heat shield have one or several openings through which in each case a lance can be inserted into the interior of the pot. The gases and dusts escaping from the melt during the pot treatment can overflow into the interior of the suction hood between the heat shield and the pot rim through the air gap and are removed with the sucked-in ambient air.

Decisive for the operability of such an installation, aside from adequate dimensioning of the suction device, is especially the size and time constancy of the effective intake cross section for the process gases and the ambient air. In this respect, the device according to EPC Patent Application No. 00 92 652 has the disadvantage that, during operation, skulls may form on the upper rim of the pot, preventing the heat shield from being lowered to the required height above the pot. As a result, the air gap between the pot rim and the heat shield is enlarged, so that the flow rate in the air gap and thus the suction effect is reduced. Since the ambient that is sucked in also passes through this air gap, it can happen that, e.g., because of an outer air flow running crosswise to the pot, on one side air is pressed in through the air gap into the interior of the pot, while on the opposite side a correspondingly greater amount of gas is suctioned off from the interior of the pot. Thus, despite the use of suction from the pot and the use of protective gas for feeding the substances required for pot treatment and a certain resulting excess pressure in the interior of the pot, it is not guaranteed that the melt is shielded against oxygen and nitrogen from the air. As a makeshift, to avoid these side effects customarily doughnut-shaped packing seals filled with refractory material are placed on the pot rim to achieve sealing.

It is a further disadvantage of this device that, in feeding in the substances for pot treatment, the melt starts bubbling, and gases and dusts escape from The melt which are entrained by the always present strong gas flows (warm air current) directed upwards. As a result, despite the pot suction, at least part of the gases and dust press outwardly, especially past the centrally placed lance, through the openings in the heat shield or in the suction hood. The consequence of this uncontrolled thermal flow also is that air flows inwardly against the desired direction of flow through the annular gap between the pot and the lid and causes a build-up and oxygen containing contamination of the steel.

OBJECT OF THE INVENTION

Therefore it is the object of the invention to provide a metallurgical vessel of the type initially mentioned which guarantees effective suctioning-off of the process gases and dusts and at the same time provides an effective shielding of the ambient air from the molten metal.

BRIEF DESCRIPTION OF THE DRAWINGS

The presently preferred embodiment of the invention is described in detail below with reference to the single FIGURE, which is a cross-sectional and somewhat simplified view of that embodiment.

DETAILED DESCRIPTION OF THE PRESENTLY PREFERRED EMBODIMENT

A pot 5 having outwardly diverging walls 4 is filled with a steel melt 13. When in operation, if melt 13 is subjected to scavenging by a lance 14, a suction hood 1 connected to a suction device (not shown) by pipe 12 is lowered so far over the pot 5 that the suction hood 1 forms an annular gap 2 with the upper rim 10 of the pot 5. It is also possible, but not required, that the suction hood 1 extends beyond on the upper rim 10 of the pot 5. Even though a skull may already have formed on the upper rim 10 of the pot 5 so that the suction hood 1 cannot be lowered sufficiently for only a narrow annular gap 2 to develop, the operability of the vessel according to the invention is maintained.

Ambient air is sucked through the annular gap 2, thus preventing process gases and dust from escaping from the suction hood 1. To ensure that the sucked-in ambient air does not come in contact with the steel melt 13, a covering bell 3 is fastened to the inside of the suction hood 1. During operation, the lower part of the covering bell 3 is dipped into the slag cover 11 on the steel melt 13 (or, at least, ends very close over the slag cover 11) to isolate a portion of the slag cover 11. The covering bell 3 is dimensionsed so that it completely covers the scavenging spot in the slag cover 11. Corresponding annular openings 7 and 6 are coaxially placed in the suction hood 1 and the covering bell 3, respectively, so that the lance 14 can be inserted into the steel melt 13 from the outside.

To be able to adjust the covering bell 3 independently of the height of the setting of the suction hood 1 in relation to the slag cover 11, and especially to be able to place the suction hood 1 on the floor during shut downs without endangering the covering bell 3 (which is preferably formed from a refractory material or sheathed in refractory material), the covering bell 3 is linked to the suction hood 1 by one or more lifting devices 9, which can preferably be driven by a spindle rotatable by an electric motor or by hydraulic or pneumatic cylinders.

The suction hood 1 is preferably lined on the inside with a refractory material 8 to provide it with good heat resistance.

In the area above the scavenging spot around the insertion point of the lance 14, a strong upwardly directed gas flow occurs through the process gases and dusts escaping from the steel melt 13, which get into the actual suction area of the suction hood 1 through the annular opening 6. Normally it is not necessary to design the annular opening 7 in the suction hood 1 especially narrowly to prevent gases and dusts from pressing towards the outside, since adequate suction can always be guaranteed. However, under unfavorable conditions (if, e.g., the two annular openings 6 and 7 are placed very closely together), the danger exists that gases and dusts may be pressed toward the outside through the annular opening 7. In such cases it is therefore advantageous to seal off the annular opening 7 in the suction hood towards the outside. Advantageously, a labyrinth seal (not shown) is used for this purpose. Such an arrangement is illustrated in commonly assigned application Ser. No. 06/756,602, filed July 19, 1985.

The illustrated pot 5 has only a single feed for the lance 14. Accordingly, the annular openings 6 and 7 are preferably placed centerally in the covering bell 3 and the suction hood 1, respectively. However, it goes without saying that several annular openings 6, 7 can be provided for the insertion of means to treat the steel melt 13 from the outside. Such means need not necessarily be lances or probes, but can also be, e.g., electrodes, so that the invention can also be applied, e.g., to a metallurgical vessel designed as an arc furnace.

During the operation of the pot 5, the covering bell 3 is preferably lowered into the slag cover 11, completely covering the scavenging spot. The process gases and dusts escaping during scavenging from the steel melt 13 get into the actual air space of the suction hood 1 through the annular opening 6 in which lower pressure prevails and are suctioned off by the pipe 12.

At the same time, ambient air is sucked into the interior of the suction hood 1 and is removed by the pipe 12. The sucked-in air cannot get into contact with the steel melt 13 through the covering bell 3, since in the area of the annular opening 6 a strong upwardly directed gas flow always prevails. Moreover, the steel melt 13 is safely protected by the slag covering 11 outside the covering bell 3.

Metallurgical vessels according to the invention thus avoid the danger of an undesired contact of melt and ambient air that exists in the case of the prior art. Moreover, it guarantees that the gases and dust developing in the metallurgical process are completely suctioned off even though skulls may already have formed at the upper rim of the metallurgical vessel.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A metallurgical vessel comprising:

(a) an upwardly open vessel which, in use, contains a metallurgical melt, said upwardly vessel having an upper rim;

(b) a suction hood having a lower rim sized and shaped so that, in use, the lower rim of said suction hood opposes the upper rim of said upwardly open vessel but is spaced therefrom to permit ambient air to enter through an annular gap therebetween;

(c) a downwardly open covering bell having a lower rim, said downwardly open covering bell being mounted on the underside of said suction hood in position so that, in use, the lower rim of said covering bell isolates a portion of a slag cover on a metallurgical melt in said upwardly open vessel;

(d) at least one opening in said suction hood; and (e) at least one opening in said covering bell sized, shaped, and positioned relative to said opening in said suction hood so that, in use, a probe can be introduced through said at least one opening in said suction hood, through said at least one opening in said covering bell, and into the portion of the slag cover on the metallurgical melt in said upwardly open vessel isolated by said covering bell.

2. A metallurgical vessel as recited in claim 1 and further comprising means for lifing and lowering said covering bell in relation to said suction hood.

3. A metallurgical vessel as recited in claim 2 wherein said means comprise a spindle drive driven by an electric motor.

4. A metallurgical vessel as recited in claim 2 wherein said means comprise hydraulic or pneumatic cylinders.

5. A metallurgical vessel as recited in claim 1 wherein said suction hood and said covering bell each has only one opening placed in the center of said suction hood and said covering bell, respectively.

6. A metallurgical vessel as recited in claim 1 wherein said covering bell is formed of a refractory material.

7. A metallurgical vessel as recited in claim 1 wherein said covering bell is sheathed with a refractory material.

8. A metallurgical vessel as recited in claim 1 wherein said suction hood is lined on the inside with a refractory material.

9. A metallurgical vessel as recited in claim 1 wherein said at least one opening in said suction hood is tightly sealed against the ambient air.

* * * * *